US006257305B1

(12) United States Patent
Mullet et al.

(10) Patent No.: US 6,257,305 B1
(45) Date of Patent: Jul. 10, 2001

(54) METHOD AND APPARATUS FOR DRIVING AND STORING A COVERING

(75) Inventors: Willis Jay Mullet, Gulf Breeze; Donald Bruce Kyle, Pace, both of FL (US)

(73) Assignee: Wayne-Dalton Corporation, Mt. Hope, OH (US)

( * ) Notice: Subject to any disclaimer, the term of this patent is extended or adjusted under 35 U.S.C. 154(b) by 0 days.

(21) Appl. No.: 09/549,605

(22) Filed: Apr. 14, 2000

(51) Int. Cl.[7] ..... E06B 9/56

(52) U.S. Cl. ..... 160/310; 160/133; 160/375.3; 160/26; 242/375.3

(58) Field of Search ..... 160/310, 23.1, 160/133, 26, 31, 315; 242/375.3

(56) References Cited

U.S. PATENT DOCUMENTS

| | | | | |
|---|---|---|---|---|
| 667,302 | | 2/1901 | Edwards . | |
| 748,641 | | 1/1904 | Newell . | |
| 958,605 | | 5/1910 | Doring . | |
| 1,828,623 | | 10/1931 | Sacerdote . | |
| 2,173,900 | * | 9/1939 | Dunn . | |
| 2,188,509 | * | 1/1940 | Kavanagh et al. . | |
| 2,696,250 | * | 12/1954 | Michelman | 160/315 |
| 2,842,198 | | 7/1958 | Prieto . | |
| 3,583,465 | * | 6/1971 | Youngs et al. | 160/310 |
| 3,739,832 | * | 6/1973 | Sivin | 160/310 |
| 3,955,611 | | 5/1976 | Coles et al. . | |
| 4,013,113 | | 3/1977 | Frei . | |
| 4,126,174 | | 11/1978 | Moriarty et al. . | |
| 4,478,268 | | 10/1984 | Palmer . | |
| 4,601,320 | | 7/1986 | Taylor . | |
| 4,683,932 | * | 8/1987 | Bubendorff | 160/310 |
| 4,706,727 | * | 11/1987 | Leivenzon et al. | 160/310 |
| 4,878,528 | * | 11/1989 | Kobayashi . | |
| 5,048,739 | | 9/1991 | Unuma et al. . | |
| 5,054,605 | | 10/1991 | Bavis . | |
| 5,355,927 | * | 10/1994 | McKeon | 160/310 |
| 5,611,497 | * | 3/1997 | Krambeck et al. . | |
| 6,123,134 | * | 9/2000 | Thomas et al. . | |

* cited by examiner

*Primary Examiner*—Blair M. Johnson
(74) *Attorney, Agent, or Firm*—Woodling, Krost and Rust

(57) ABSTRACT

The instant invention is an apparatus for maintaining approximately constant tension of a curtain between a drive roller and a storage roller. The constant tension is achieved by pre-tensioning the curtain between the drive roller and the storage roller and then maintaining approximately the same amount of tension by rotating the reference to which one end of a spring is attached. The rotating reference is a shaft which is affixed to and rotates with a shaft gear. The other end of the spring is affixed to a cylindrical tube member, i.e., the storage roller, upon which the flexible curtain is stored. A motor driven gear drives a gear affixed to the drive roller. The gear affixed to the drive roller in turn drives idler gears which in turn drive the shaft gear. A method of using the apparatus is also disclosed.

11 Claims, 14 Drawing Sheets

METHOD AND APPARATUS FOR DRIVING AND STORING A COVERING

FIELD OF THE INVENTION

The invention relates to a driving and storing mechanism for flexible curtain material that covers openings in a structure which provide protection for the opening from high wind velocity pressure (i.e., hurricanes and tornadoes) and impacts from windborne debris. Instead of a flexible curtain any type of covering including a garage door or other structure made of slats may be used employing the principles of the instant invention. The mechanism of the invention includes a system where a substantially constant tension is maintained on the curtain material as it is unwrapped from its storage roller to close an opening in a structure and as it is wrapped in returning it to the fully stored condition.

BACKGROUND OF THE INVENTION

It is desired to keep approximately the same amount of tension on the curtain as it is lowered from the completely stored position into the completely dispensed position. Further, it is desired to keep approximately the same amount of tension on the curtain between the storage roller and the driving roller. Constant tension on the curtain between the storage and driving rollers results in the curtain's smooth storage in a small area. Further, and importantly, constant tension between the storage and driving rollers enables use of a smaller and lower powered electric motor. Employing a variable reference point for the spring of the instant invention enables the maintenance of approximately constant tension in the flexible curtain as it traverses between the open and closed positions and between the closed and open positions. By closed it is meant that the curtain covers the opening in the building and by open it is meant that the curtain does not cover the opening in the building. In the closed position the curtain is fully deployed or dispensed from the storage roller and in its open position the curtain is fully stored or wound on the storage roller. Without a variable reference, the driving motor must use more energy as the curtain progresses from the open position toward a closed position. During rewind of the curtain from the closed position to the open position, constant tension between the driving roller enables smooth winding of the flexible curtain of the storage roller.

U.S. Pat. No. 958,605 to Doring discloses a fixed sleeve "c" and a nut "l" having lugs or projections "k." Nut "l" moves leftwardly and rightwardly as it is driven by threaded shaft "g." A curtain is affixed to a roller "a" and the roller is affixed to a toothed gear/hub "b." Gear/hub "b" is rotatable with respect to the fixed sleeve "c." Gear "b" drives gears "d" and "e" which drive gear "f" in the same direction as gear "b." Gear "f" is affixed to shaft "g" which is threaded. Rotation of the roller "a" causes the threaded shaft "g" to rotate through nut "l" causing nut "l" to move leftwardly storing energy in the spring as the curtain is pulled downwardly. The spring is fixed at one end, however, and a variable reference is not employed. Energy stored in the spring is released when the curtain is released from a restraint and it is this energy which returns the curtain to its stored position.

U.S. Pat. No. 2,842,198 to Prieto discloses a split ring torsion regulator which limits expansion and, hence, tension in a spring. The split ring is adjustable but a variable reference is not employed.

U.S. Pat. No. 667,302 to Edwards discloses an apparatus by which the tension of the spring in a roller may be changed or adjusted without the removal of the roller from its brackets or mountings. More specifically, a spring is connected to a roller and to a rotatable part or a spring is connected to a barrel and a rotatable spindle. The rotatable part or the rotatable spindle are adjustable as desired. However, the adjustment is permanent and does not provide a variable reference point for the spring in either instance.

U.S. Pat. No. 1,828,623 to G. M. Sacerdote discloses a pulley driven shaft and a spring connected to its shaft and to a roller. When the screen is unwound from the roller the belts will be wound around the pulleys and vice versa. As the screen and belts are thus wound, the diameter of the roller and pulleys vary and the tension upon the screen is such to keep the curtain taut, varying between two limits which are not far apart.

U.S. Pat. No. 3,955,611 to Coles et al. discloses an awning construction particularly adapted for mounting on a mobile home. The awning includes an awning shade having one end fixed to an outside wall of the mobile home, and the other end of the awning shade is attached to an awning roller, which roller is pivotedly connected to the same outside wall. The awning roller includes an elongated torque rod which is nonrotatably connected to a pair of support arms. The support arms are pivotedly connected to the outside wall. A tube is rotatably mounted on the torque rod and is secured to the other end of the awning shade. A torsion spring connects the torque rod with the tube to rotate the tube relative to the torque rod and holds the tube up against the wall of the mobile home in its normal condition. A lock 126 releasably locks the tube relative to the torque rod to allow the tube to stay selectively in an extended position away from the side wall. See, FIG. 6.

U.S. Pat. No. 4,013,113 to Frei discloses a shutter which includes a curtain formed of elongated bars hinged to one another at longitudinal edges and guided at their ends in laterally spaced guide grooves extending along opposite sides of an opening to be controlled by the shutter. A rotatable member is mounted in an upper receiving zone, such as a lintel above the opening, and the rolling bar curtain is trained about this member for direction reversal during raising and lowering. The laterally spaced guide grooves extend along the peripheral portion of this rotary member and are then branched to form branch guide grooves extending downwardly from the rotatable element into a recess formed in the lintel or the like. Guide elements, such as pins or rollers on the ends of each bar, cooperated with the branch guide means to conjointly guide the bars to form at least one vertical pile of bars superposed in horizontal orientation in the recess, responsive to raising of the curtain. The rotatable element may be circular or may be polygonal and if polygonal, has sides each conforming to the width of a bar of the curtain. This invention is demonstrative of the complexities of guiding and managing a curtain that is somewhat flexible and made from rigid sections.

U.S. Pat. No. 4,478,268 to Palmer discloses a door for closing a vehicular traffic passageway. The door is a curtain fabricated from a hard flexible material. The curtain runs in opposing channels, is mounted on a counterbalanced windup drum and under impact changes weight and moves out of the channels and is wound up to open the vehicular passageway.

U.S. Pat. No. 4,601,320 to Taylor discloses a pressure differential compensating door which includes a curtain for closing a doorway having a first upper end, a second lower end and side edges and a counterbalanced curtain winding mechanism having the first end of the curtain attached thereto for raising and lowering the curtain.

None of the related art, however, solves the problem of maintaining approximately constant tension between the storage roller and the drive roller throughout the travel of the curtain from a fully stored position to a fully deployed position and back. Further, none of the related art solves the problem of maintaining approximately constant tension between the drive roller and the storage roller so as to enable use of a relatively low power motor. Present designs require the use of a large motor so as to overcome the resistance of a spring connected at one end to a storage roller and at the other end to a fixed structure (ground). Present designs require a large motor because the resistance of the spring increases linearly as the curtain extends toward its fully deployed position.

SUMMARY OF THE INVENTION

The instant invention is an apparatus for maintaining approximately constant tension of a curtain between a drive roller and a storage roller. The constant tension is achieved by pre-tensioning the curtain between the drive roller and the storage roller and then maintaining approximately the same amount of tension by rotating the reference to which one end of a spring is attached. The rotating reference is a shaft which is affixed to and rotates with a shaft gear. The other end of the spring is affixed to a cylindrical tube member, i.e., the storage roller, upon which the flexible curtain is stored. A motor driven gear drives a gear affixed to the drive roller. The gear affixed to the drive roller in turn drives idler gears which in turn drive the shaft gear.

It is an object of the present invention to provide an apparatus for maintaining approximately constant tension on a flexible curtain between a storage roller and a drive roller. Cogs or toothed projections on the driving roller engage apertures in the flexible curtain enabling the curtain to be driven between open and closed positions.

It is an object of the present invention to provide an apparatus for storing and driving a flexible curtain which requires a low power motor. A low power motor may be used when the tension between the driving roller and the storage roller is approximately constant between initial (curtain fully stored) and final (curtain fully dispensed) conditions.

It is an object of the present invention to provide a method for opening and closing a flexible curtain under approximately constant tension between a storage roller and a driving roller.

A better understanding of the drawings will be had when reference is made to the Description of the Invention and the claims which follow hereinbelow.

DESCRIPTION OF THE INVENTION

Figure 4:
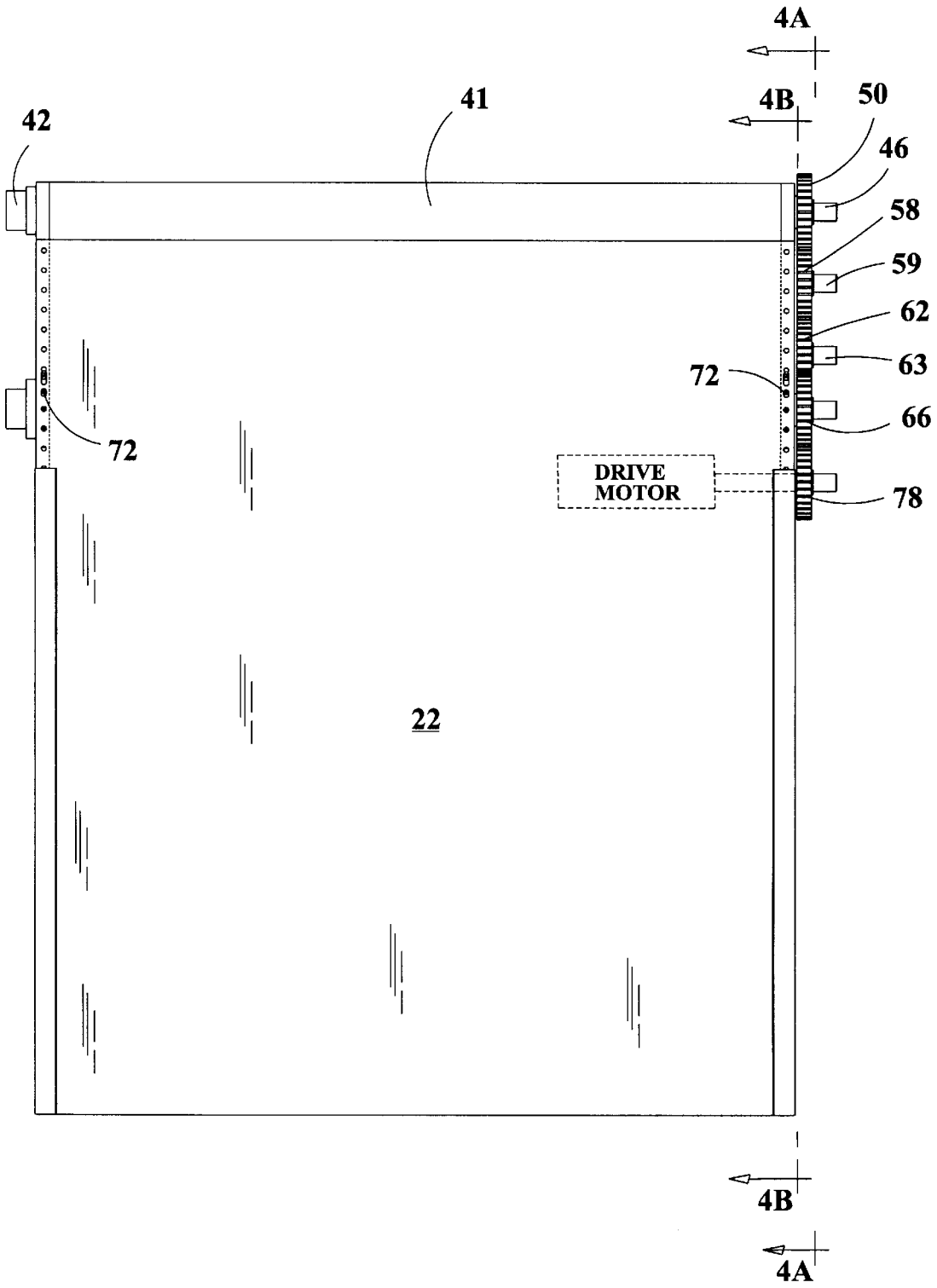
FIG. 4 is a view similar to FIG. 1 but omits the openings in the building structure as seen in phantom in FIG. 1.
Figure 4A:
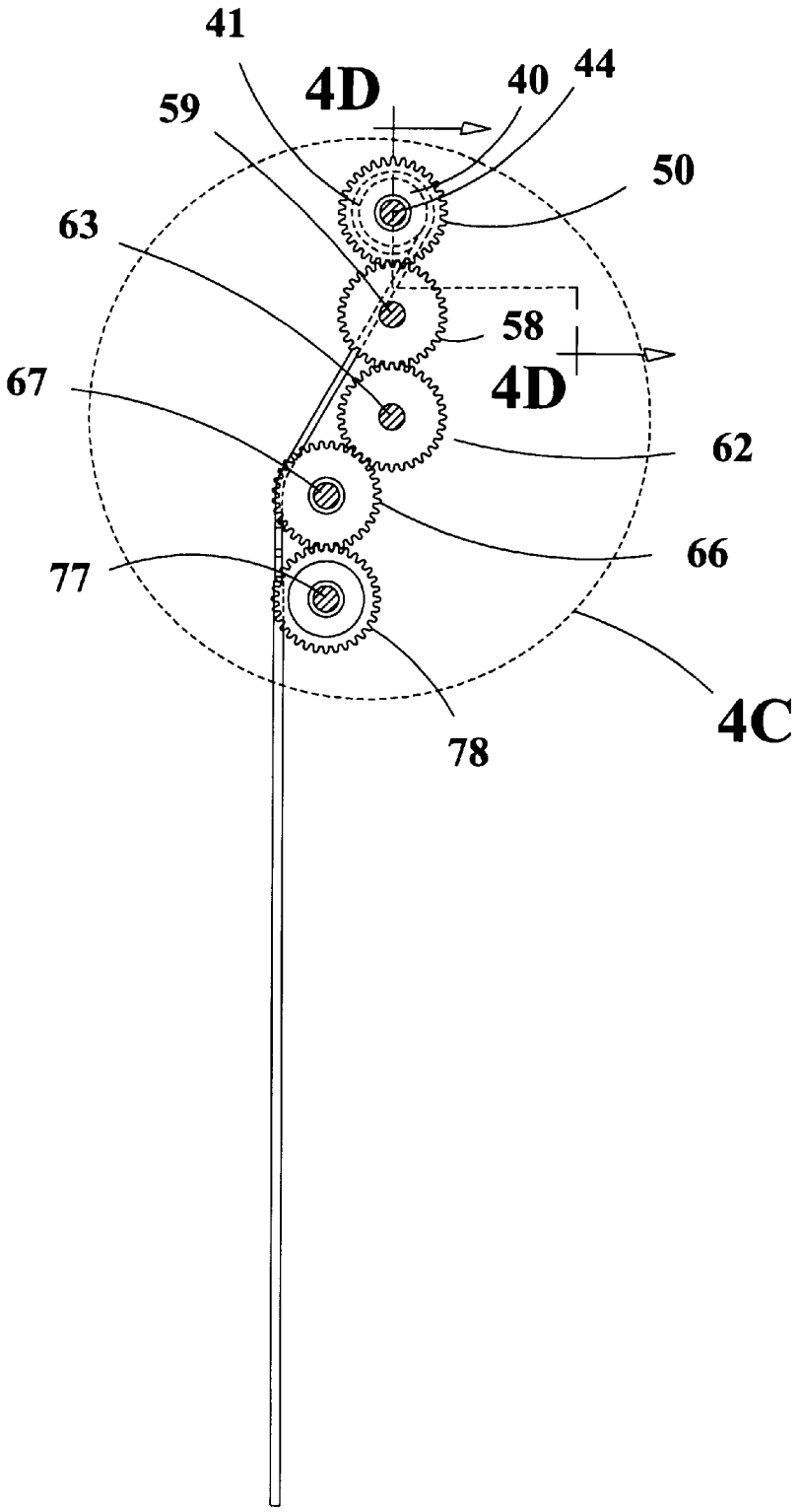
FIG. 4A is a diagrammatic view taken generally along the lines 4A—4A of FIG. 4 illustrating the arrangement.
Figure 4B:
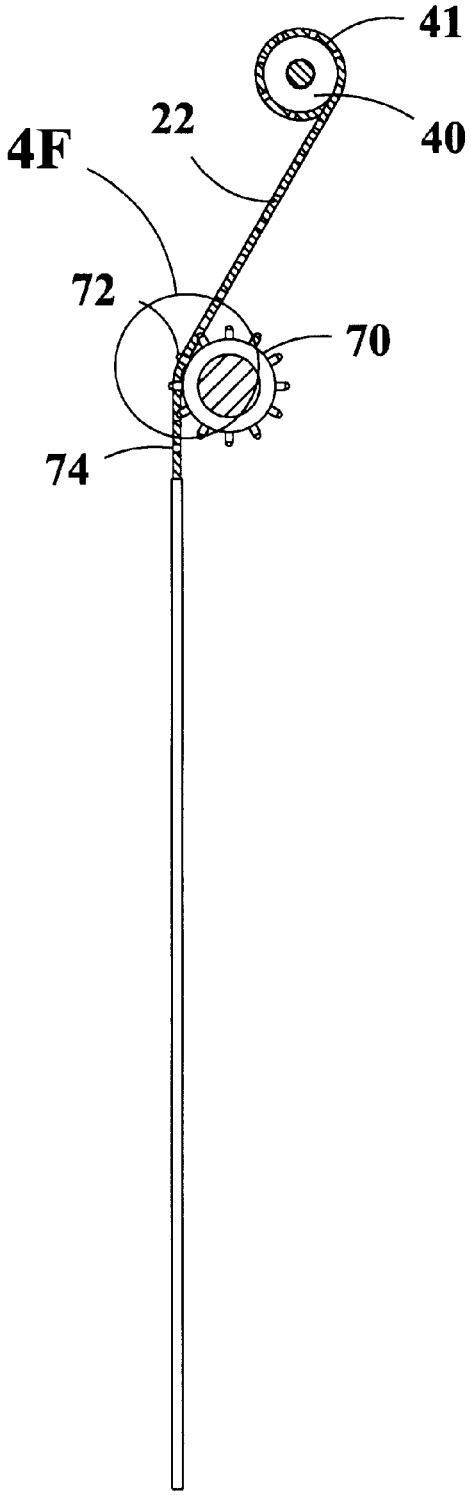
FIG. 4B is a view taken generally in the same direction as FIG. 4A but showing only the tube member (storage roller) which is used to store the flexible curtain material and the curtain engagement member (drive roller) which is used to engage and drive the curtain material in its up and down movements.
Figure 4C:
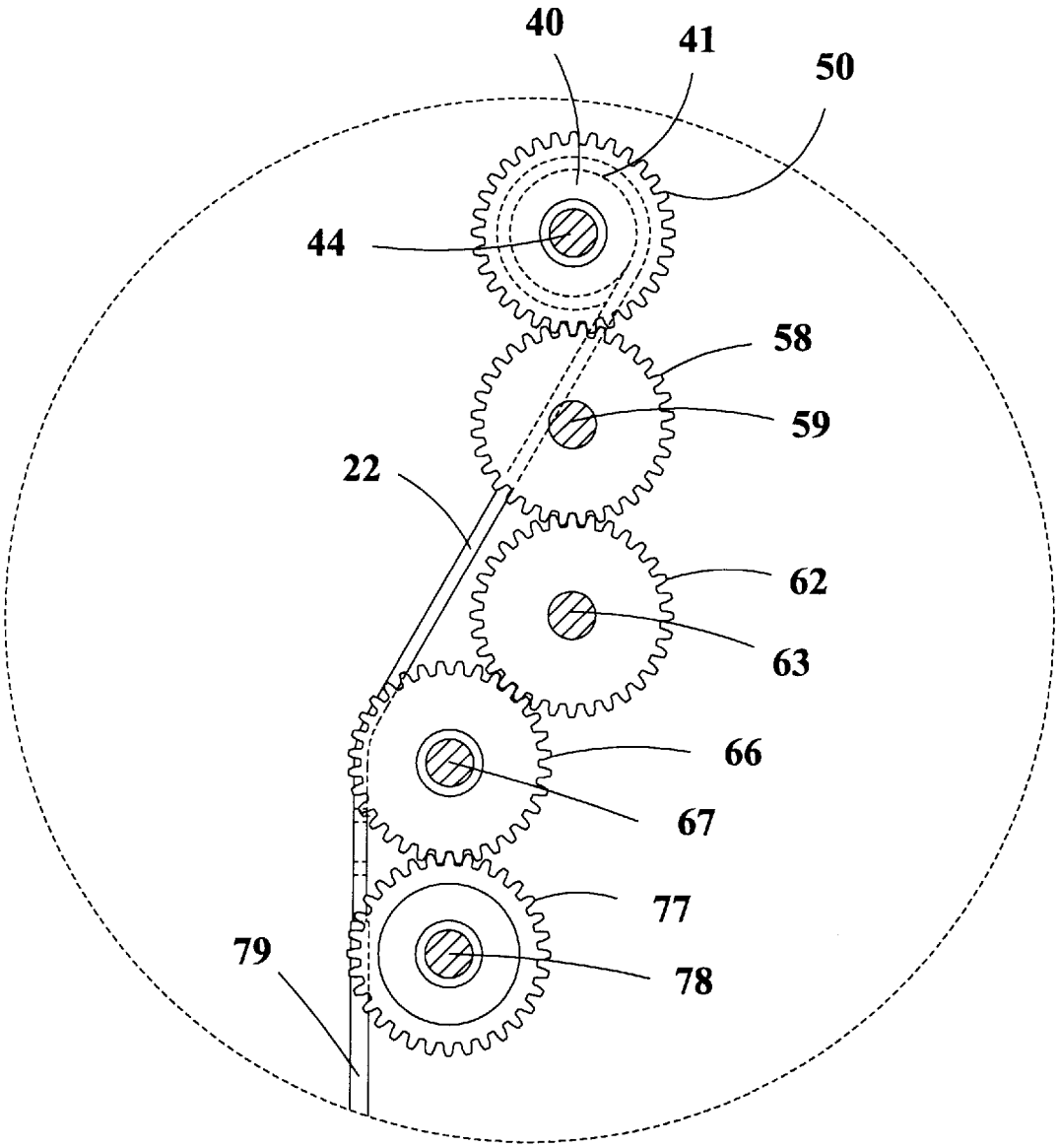
FIG. 4C is an enlarged portion of FIG. 4A.
Figure 4D:
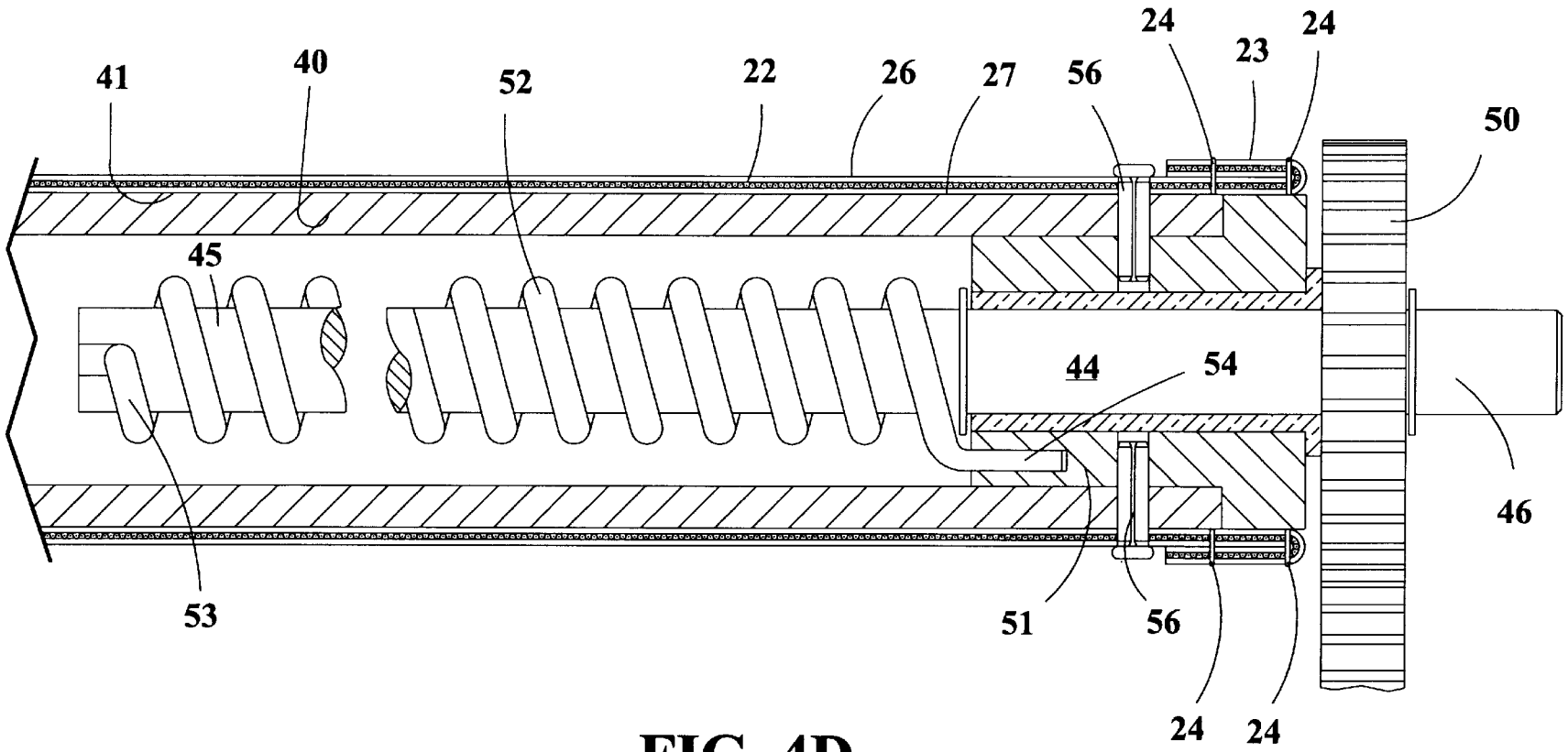
FIG. 4D is an enlarged partial cross-sectional view taken generally along the lines 4D—4D of FIG. 4A and showing the cylindrical tube member (storage roller) upon which the flexible curtain material is wrapped in stored condition.

Referring to FIG. 4D, a cylindrical tube member 40 (sometimes referred to as a storage roller 40) has an outer cylindrical surface 41 for the reception of a length of curtain material 22 in a rolled up configuration. The storage roller 40 is mounted in the frame structure of a window opening. See, FIG. 1A as well. This frame structure includes 2×6 inch wooden members 29 and as shown in FIG. 1A, siding 31 covering the exterior of the building and plasterboard or other internal wall structure 32. Vertical bearing members 35 and 36 are provided in the building structure 28 and serve to position and mount the storage roller 40 and other structures to be described hereinafter. One end of the storage roller 40 at 42 is mounted for rotation in the bearing structure 35 and the other end is mounted for rotation in the bearing member 36. This is accomplished by a first shaft 44 best seen in the enlarged view of FIG. 4D which has first 45 and second 46 end portions with the first end portion 45 extending coaxially into the tube member 40 and with the second end portion 46 of the first shaft 44 extending exteriorly of the tube member. This second end portion 46 is seen as extending into the vertical bearing member 36 in FIG. 1A.

Still referring to FIG. 4D, a first gear 50 is connected to the second end portion 46 of the first shaft 44 for rotation in unison therewith. A torsion spring 52 as seen in FIG. 4D surrounds the first end portion 45 of the first shaft 44. First end 53 of spring 52 is connected to the first end portion 45 of the first shaft 44. Second end portion 54 of spring 52 is connected to sleeve 51 which is affixed to storage roller 40 by pins 56 secured to the storage roller 40 and sleeve 51. With this construction, it will be apparent to those skilled in the art that a cylindrical tube or storage member 40 and the shaft 44 may be rotationally positioned in a plurality of positions with respect to each other which are dependent on the spring constant and the desired tension between the storage members and the driving roller 70. This will be referred to hereinafter as pre-tensioning the storage roller 40 relative to the driving roller.

Referring to FIGS. 4, 4A and 4C, a first idler gear 58 is mounted for rotation about a first idler shaft 59 and it is in meshing engagement with the first gear 50. The first idler shaft 59 is mounted in the vertical bearing member 36. A second idler gear 62 is mounted for mounted for rotation about a second idler shaft 63 and gear 62 is in meshing engagement with the first idler gear 58. The idler shafts are mounted in vertical bearing member 36. A curtain drive gear 66 is mounted for rotation about a second shaft 67 and it is in meshing engagement with the second idler gear 62. The second shaft 67 is likewise mounted and supported by vertical bearing member 36. See, FIG. 1A.

A curtain engagement member, 70, sometimes referred to herein as a roller drive 70, is also mounted on the second shaft 67 for rotation therewith and in unison with the curtain drive gear 66. The curtain engagement member 70 is provided with pins 72 at each of its two end portions which are rotatively or circumferentially spaced from each other and are adapted to fit into openings 74 in the flexible curtain material so that when the drive roller 70 is driven rotatively, it drives the curtain material either up or down depending upon the direction of rotation.

Figure 1:
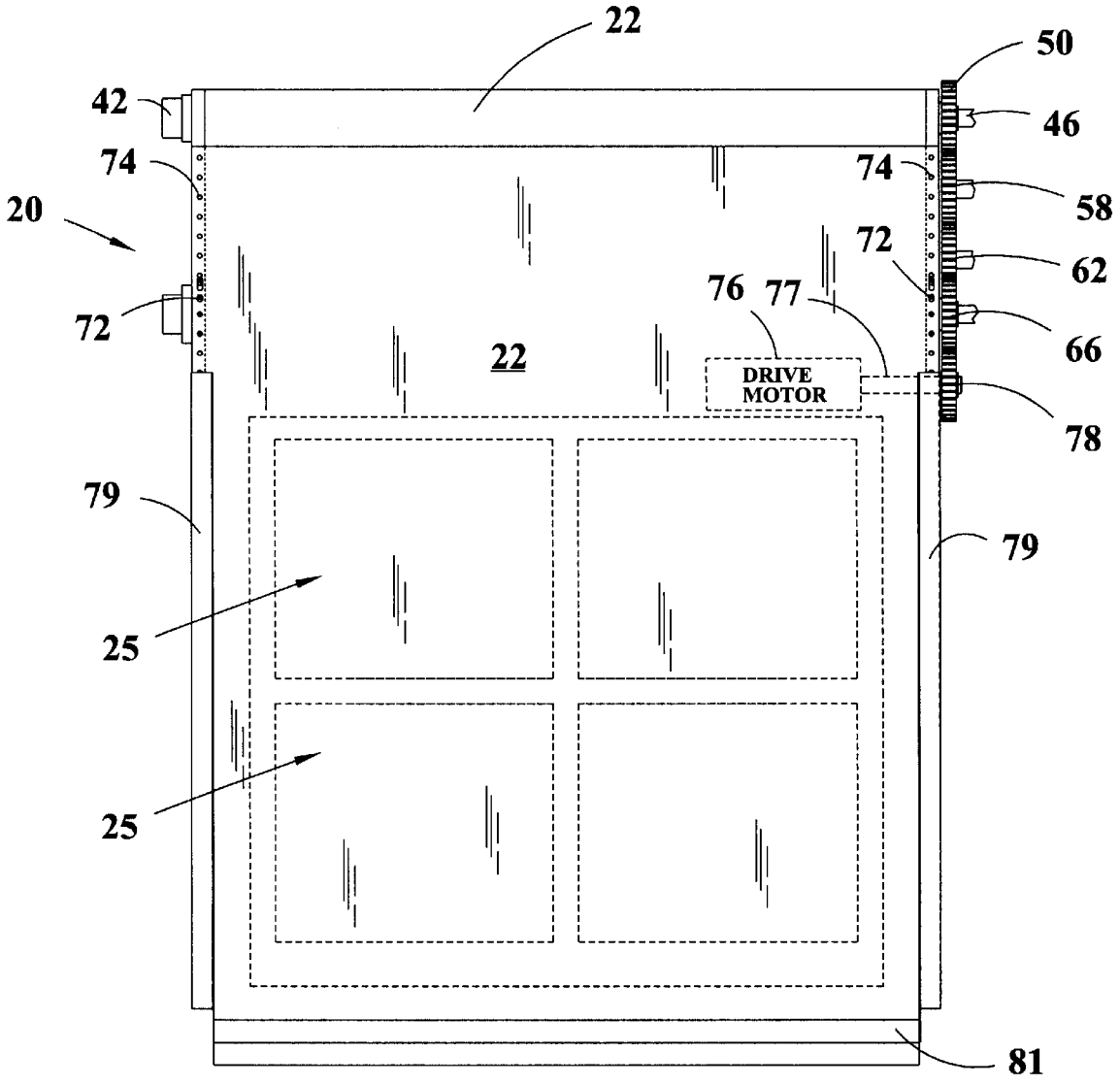
FIG. 1 is a front elevational view of the driving and storing mechanism of the present invention illustrating the curtain material covering an opening (shown in phantom) in a building structure.
Figure 1A:
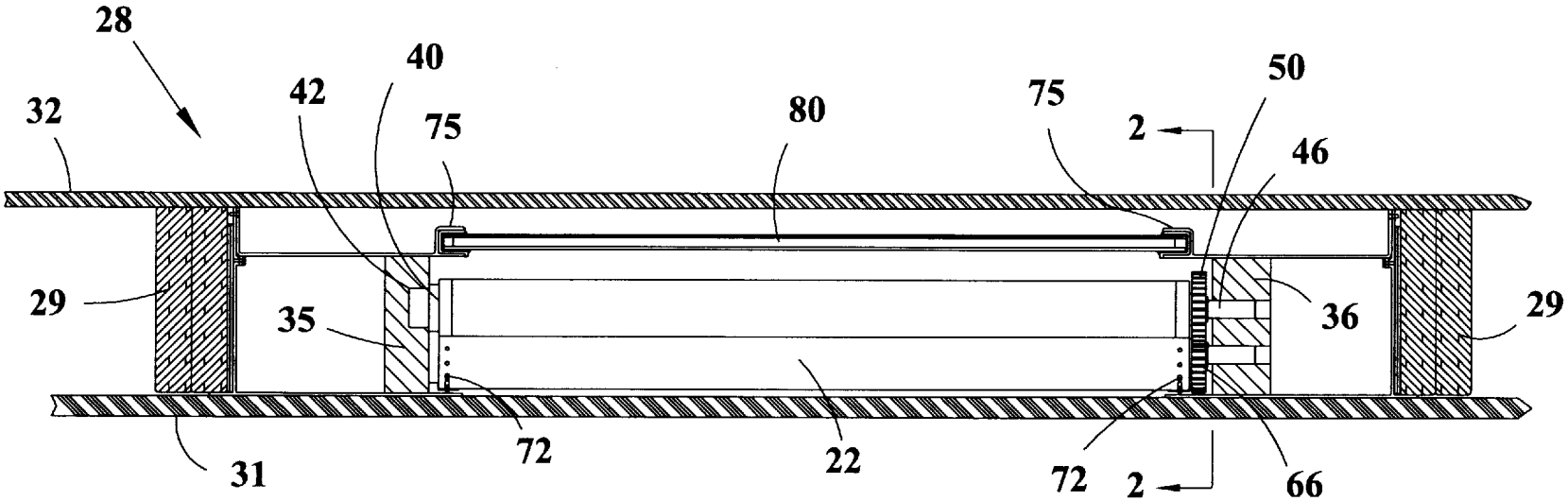
FIG. 1A is a vertical cross-section of the mechanism shown in FIG. 1 and specifically illustrated as being along the lines 1A—1A of FIG. 2.
Figure 3:
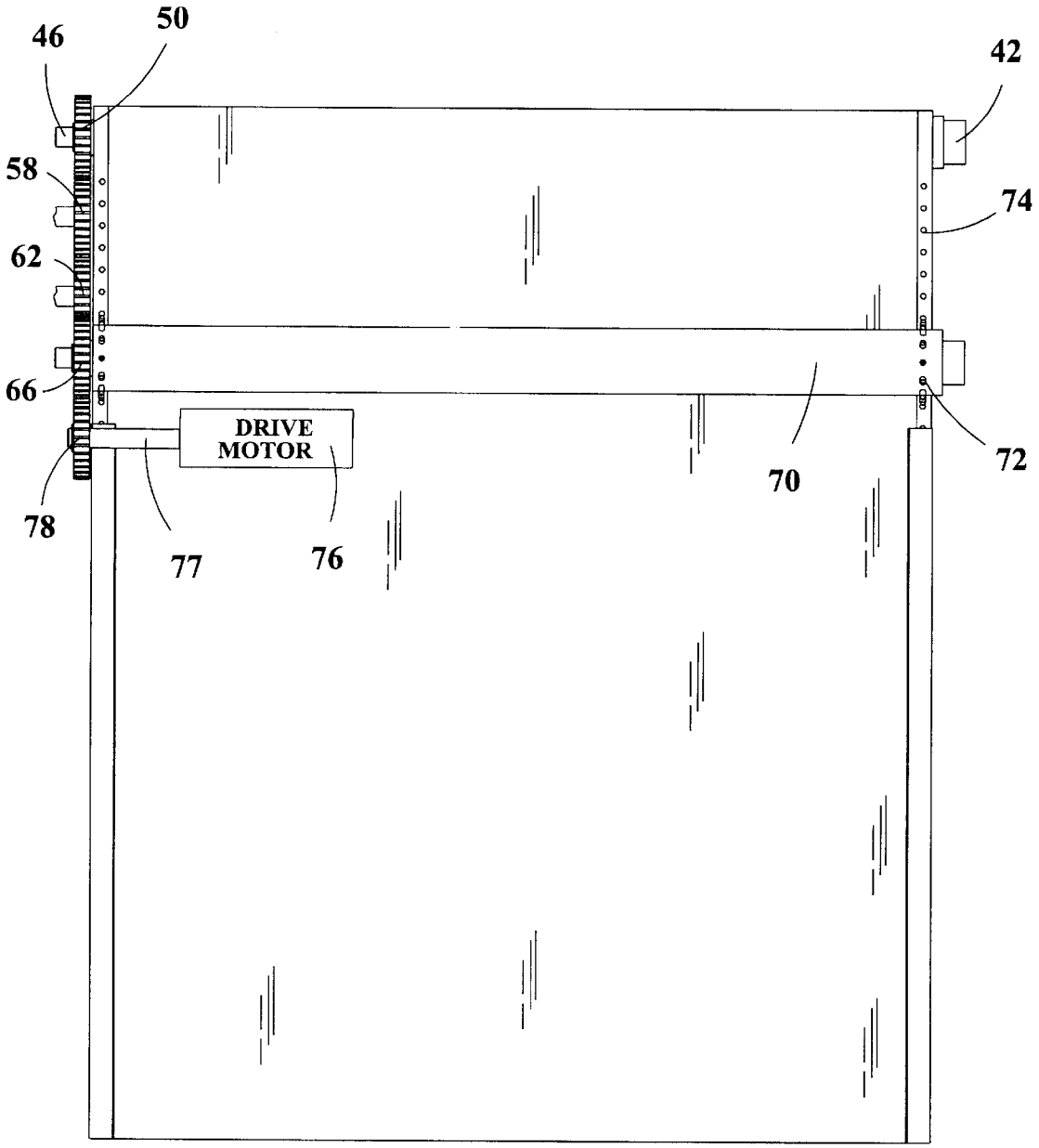
FIG. 3 is a rear view of the driving and storing mechanism illustrated in FIG. 1.

Referring to FIGS. 1, 3, and 4, drive motor 76 is mounted in the mechanism and has a drive shaft 77 which in turn is rotatively connected to a drive gear 78 which meshes with the curtain drive gear 66. Rotation of the drive motor in one direction therefore causes the curtain material to be unrolled from the tube member to cover an opening 25 as illustrated in FIG. 1 and in the opposite direction causes the curtain material 22 to fold up onto storage roller 40 to uncover the opening.

Figure 2:
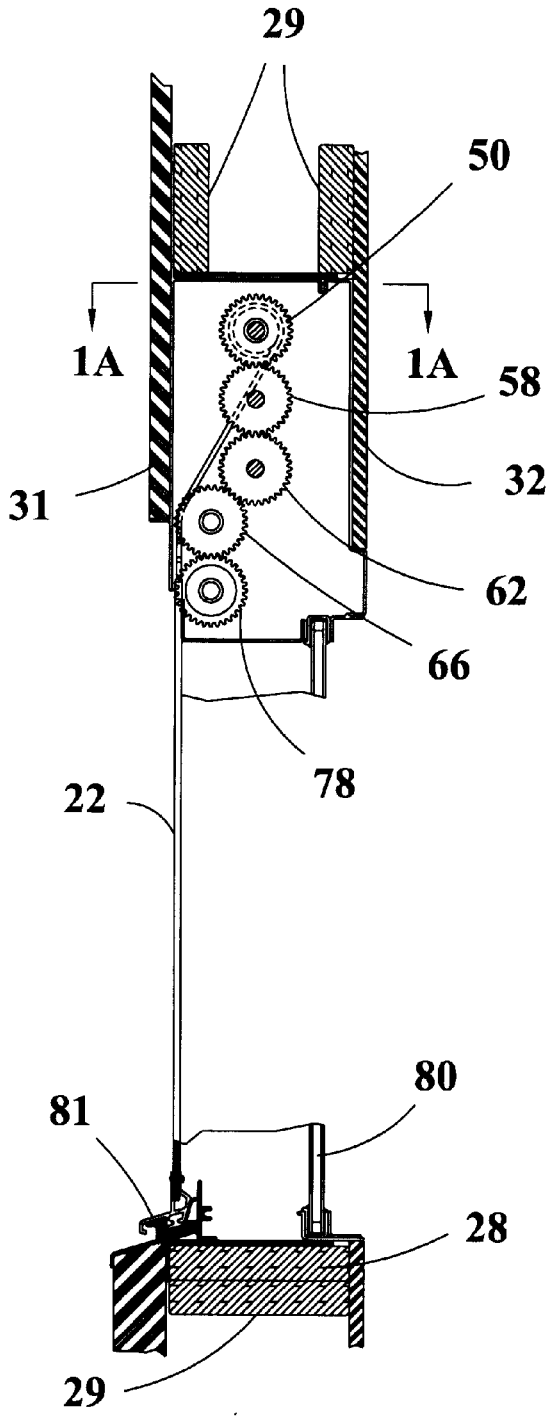
FIG. 2 is a fragmentary cross-sectional view taken generally along the lines 2—2 of FIG. 1A.

Guides 79 on opposite sides of the structure (see FIG. 1) are adapted to receive the outer edges of the flexible curtain material to keep it in position as it moves from its lowermost to its uppermost position. A latch 81 (FIG. 2) is adapted to secure the curtain in its lowermost position.

Figure 5:
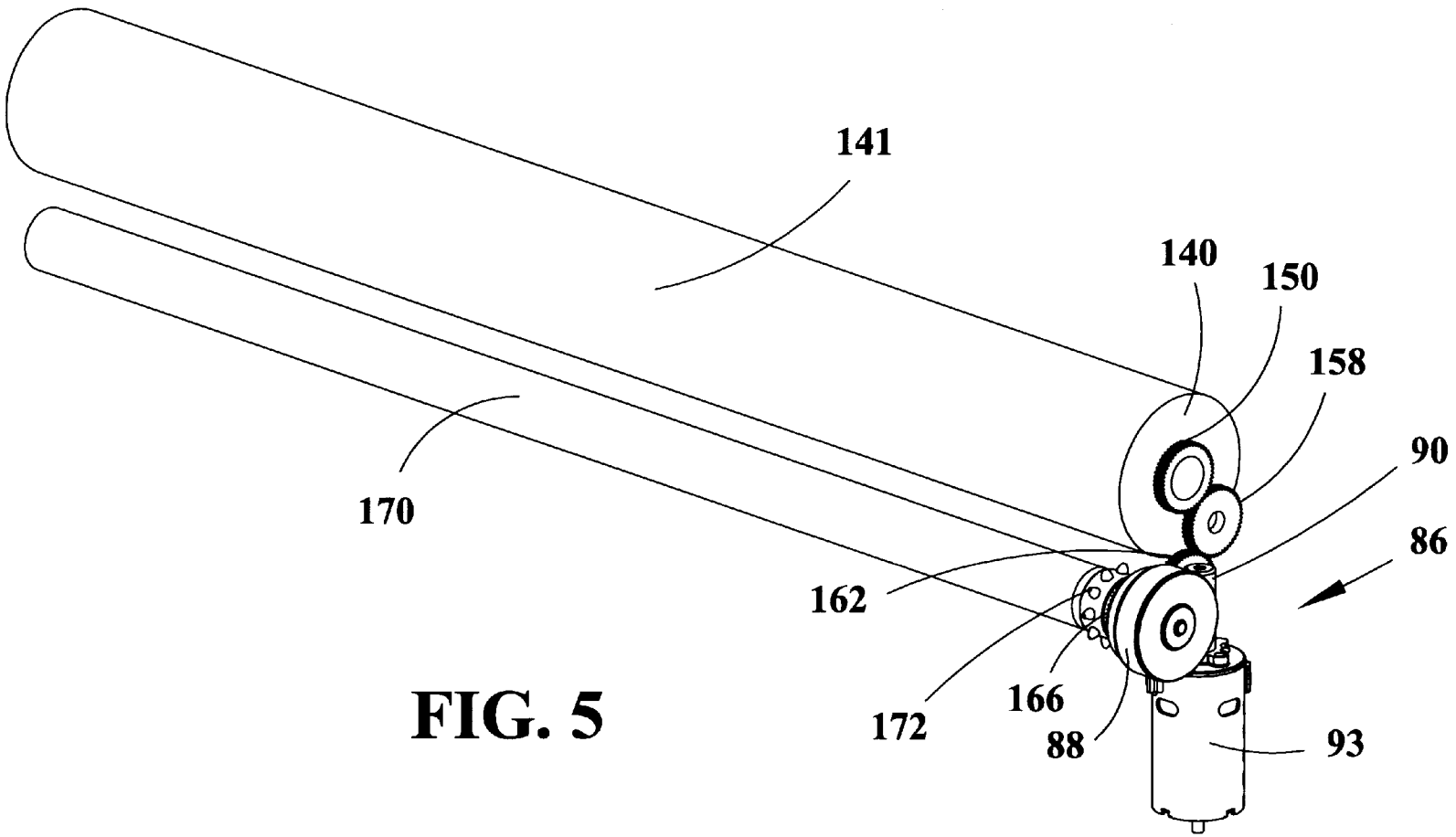
FIG. 5 is an isometric view of a variation in the means for driving the storing mechanism illustrated in the previous figures.
Figure 6:
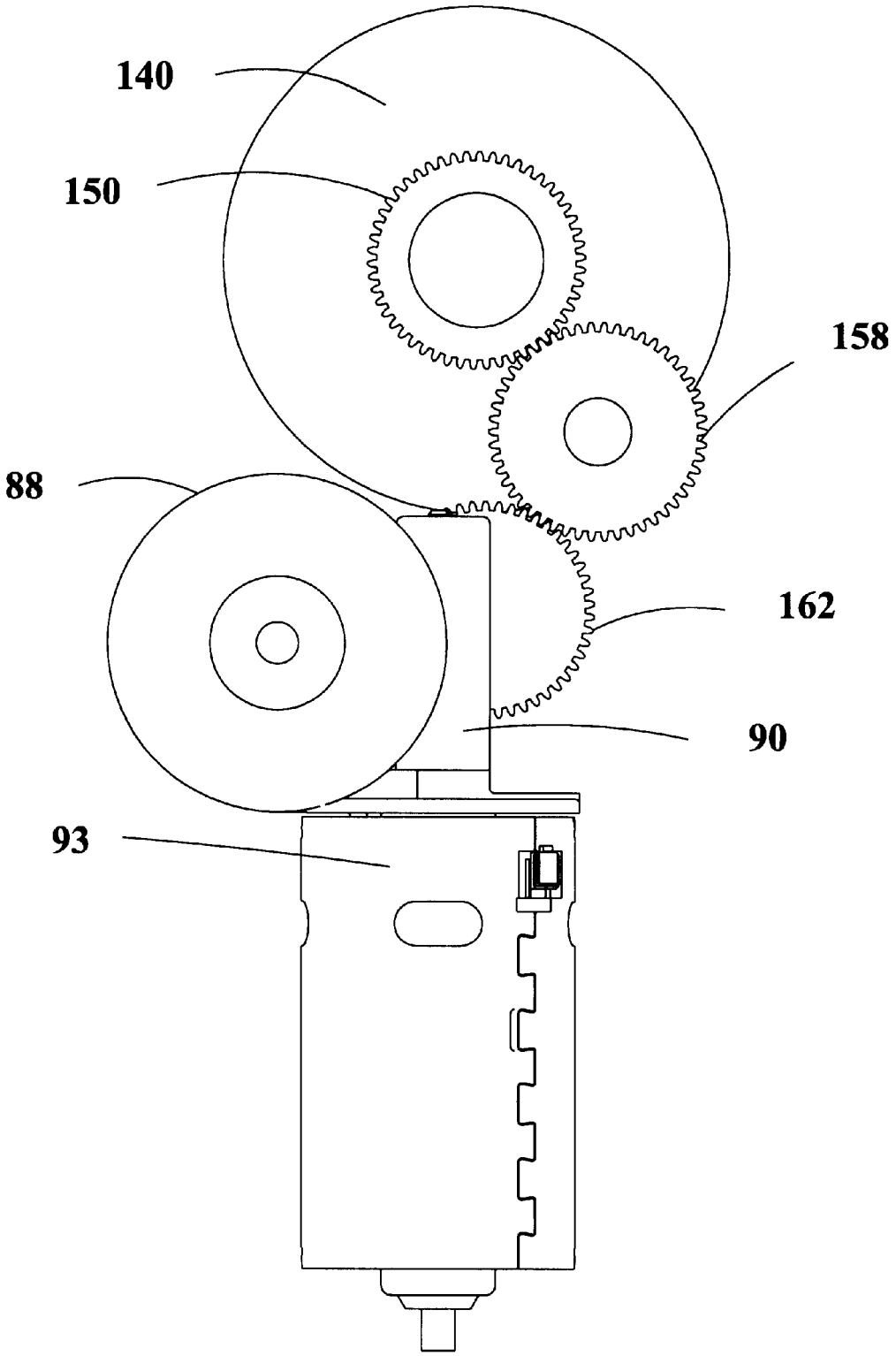
FIG. 6 is an elevational view of the electric motor and its connections and as illustrated in FIG. 5.
Figure 7:
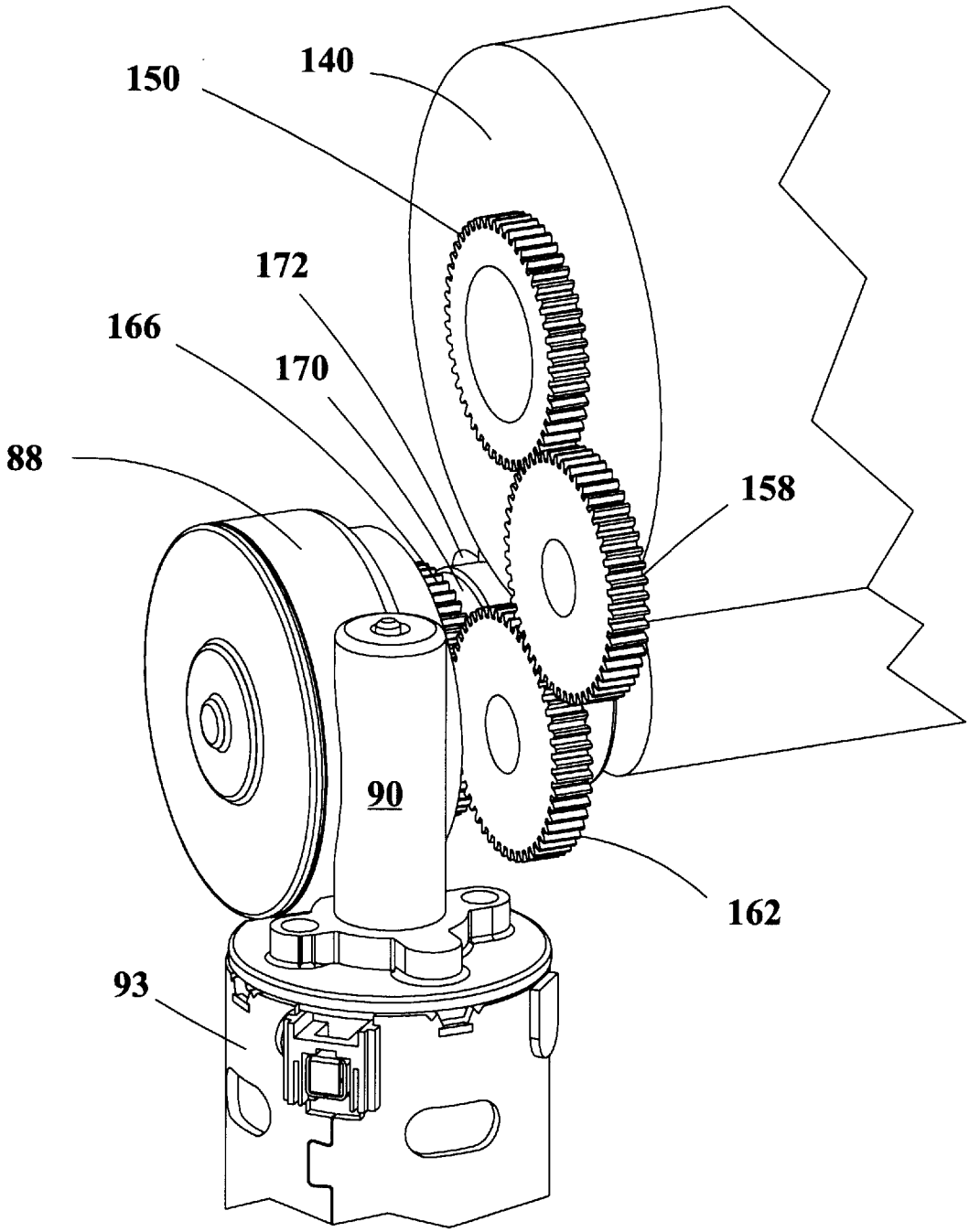
FIG. 7 is a fragmentary isometric view from another angle illustrating the parts also shown in FIG. 5 and FIG. 6.

FIGS. 5, 6 and 7 are simply different showings of how the drive and storing mechanism can be motorized to be driven between its uppermost and lowermost positions. In these figures where the structure is essentially the same as in FIGS. 1–4, reference numerals 100 units higher have been designated to illustrate the parts. Drive roller 170 is driven by drive gear 166 which, in turn, is driven by the worm gear drive 86. Drive gear 166 drives idler gear 162 which drives idler gear 158. Idler gear 158 drives gear 150 which drives the shaft (not seen).

The mechanism of FIGS. 5–7 primarily is an alternative to the drive motor 76 shown in the previous drawing and its drive shaft 77 as well as gear 78. In this showing there has been illustrated a worm gear drive indicated generally by the reference numeral 86 and this worm gear drive includes a worm gear housing 88 and a worm gear reduction housing 90. See, FIG. 5. The associated gears (not shown) within these housings are driven from motor 93. The motor is reversible which enables the mechanism to drive the curtain in either an up direction or a down direction. The drive mechanism in FIGS. 5–7 illustrates variations in drive mechanisms which can be used to couple the drive roller 170 to the storage roller 140.

Figure 4E:
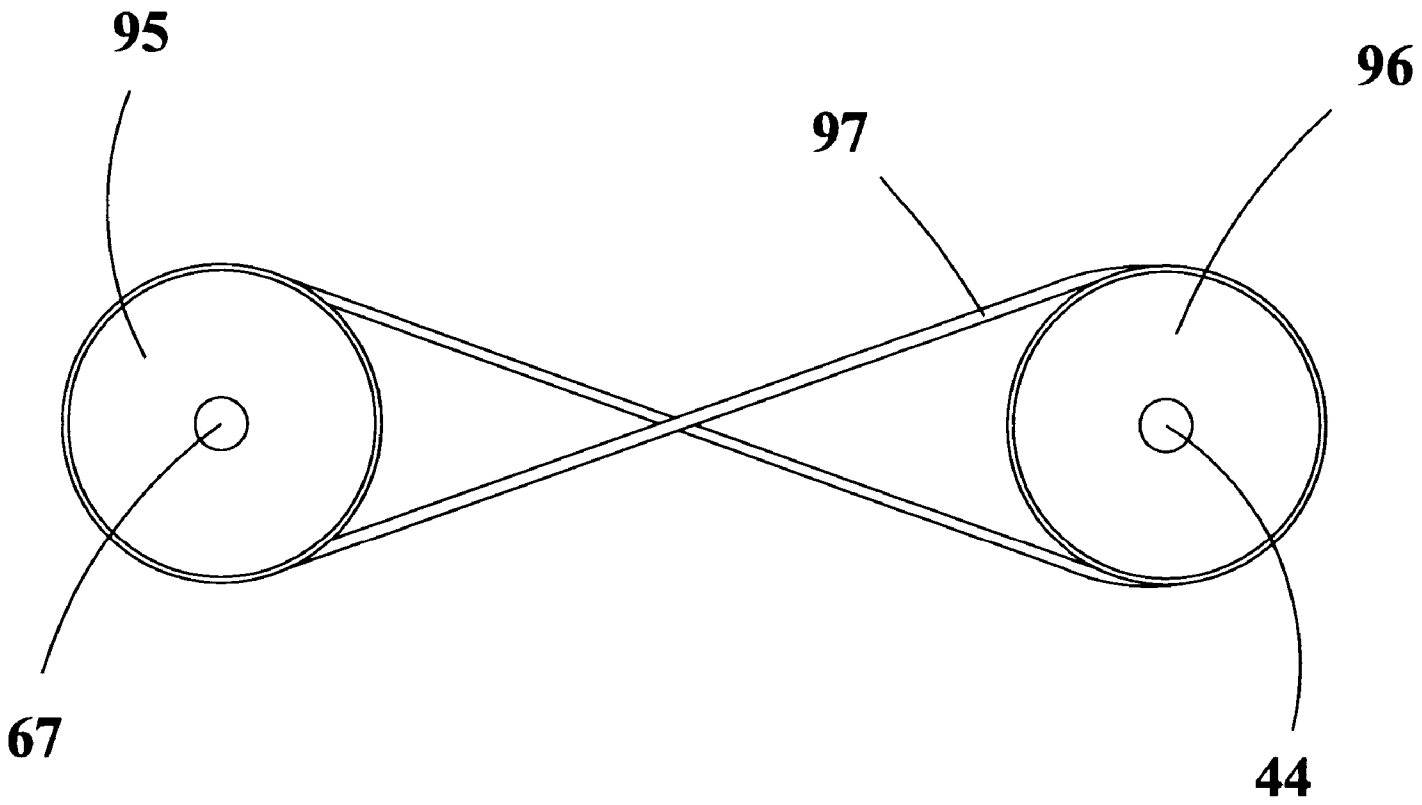
FIG. 4E illustrates an inverted belt drive 97 operating between a pulley affixed to the drive shaft and a pulley affixed to a shaft within the storage roller.
Figure 4F:
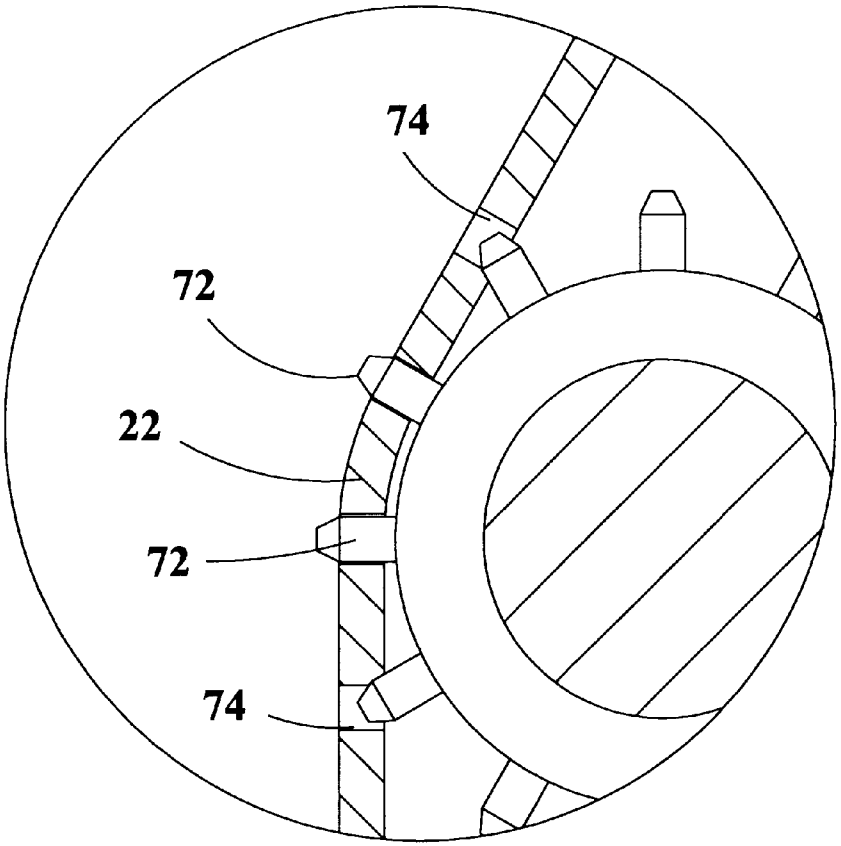
FIG. 4F is an enlarged portion of FIG. 4B illustrating the interengagement of cogs/pins of the drive roller with apertures in the flexible curtain.

FIG. 4E illustrates an inverted belt drive 97 operating between pulley 95 affixed to shaft 67 and pulley 96 affixed to shaft 44. Referring to FIG. 4C, rotation of the drive shaft 78 in a clockwise direction results in rotation of shaft 44 in a counterclockwise direction. Similarly, rotation of the drive shaft 67 in a counterclockwise direction results in rotation of shaft 44 in a clockwise direction. Inverted belt drive maintains this relationship because it is inverted. A motor may still be used to operate a gear affixed to shaft 67 but use of the belt would eliminate the need for the idler gears and the gear 50. The belt would have to be reasonably tight so as to prevent slippage during pre-tensioning. As with the gearing arrangement set forth in FIG. 4A, it is necessary that the curtain apertures 74 engage at least two of the cogs 72 to insure tensioning of the curtain and positive driving of the curtain. FIG. 4F is an enlarged portion of FIG. 4B illustrating the interengagement of cogs/pins 72 of the drive roller with apertures 74 in the flexible curtain. FIG. 4A illustrates the storage roller 40 placed rightwardly or rearwardly from the drive roller 70. This insures that the curtain 22 will sufficiently wrap around roller 70 and constantly engage at least two cogs/pins 72.

Referring now particuarly to the detailed drawing of FIG. 4D, it will be appreciated by those skilled in the art that pre-tensioning of the mechanism is accomplished by rotating the cylindrical tube member 40 relative to the shaft 44. The curtain 22 is affixed to the storage roller 40 by mushroom headed pins 56. The storage roller is rotated clockwise as viewed in FIGS. 4A or 4C. Roller 40 rotates clockwise and creates tension in spring 52 as shaft 44 does not turn since the gear train 78, 66, 62, 58 and 50 are locked up through resistance of the gears, the driver roller 70 and the inertia of the drive motor. Sleeve 51 rotates with roller 40 as the curtain is pulled by hand downwardly such that the openings 74 of the curtain material 22 fit over the pins 72 in the drive roller 70. The relative movement between the storage roller 40 and the shaft 44 creates tension in the torsion spring 52 to a predetermined level and the tension is then maintained by placing the openings 74 over the pins 72.

Referring to FIG. 4B, the curtain 22 extends from the back side of storage roller 40 and engages cogs/pins 72 so as to secure the curtain 22 over the cogs/pins 72. Cogs/pins 72 are on both sides of the drive roller 70. Apertures 74 are formed in the curtain 72 where the curtain is folded over onto itself. See, FIG. 4D. Reference numeral 23 represents the folded portion and stitching 24 secures the folded portion to the main portion of the curtain.

The curtain 22 is positioned by the rotation of the drive roller 70. Usually, the curtain 22 is a three ply curtain having a reinforced polyester sheet laminated between two polymeric plys. As such, the curtain is usually of lightweight construction.

Referring to FIG. 4C, as the curtain drive gear 66 is rotated counterclockwise to bring curtain 22 downwardly, idler gear 62 is rotated clockwise, idler gear 58 is rotated counterclockwise and the first gear 50 connected to shaft 44 is rotated clockwise. As indicated in FIG. 4C, all of the gears are the same size such that one rotation of curtain drive gear 66 results in one rotation of first gear 50 in the opposite direction. Any size gears may be used and the relative positioning of the gears may change. It is necessary, however, to maintain the ratio of the drive gear 66 to the first gear 50 in approximately a 1:1 ratio so as to ensure approximately uniform tensioning between the drive roller 70 and the storage roller 40. The size of the motor drive gear may change without affecting the 1:1 ratio.

From the initial condition of the curtain material 22 being fully stored on the storage roller 40, and hence the diameter of the stored curtain being larger than the diameter of the drive roller 70, one counterclockwise rotation of drive gear 66 results in one clockwise rotation of first gear 50 and shaft 44 but roller 40 rotates in the clockwise direction (referring to FIG. 4C) less than one rotation thus changing slightly the pretension in the curtain between the storage roller 40 and the drive roller 70. Those skilled in the art will readily recognize that the diameter of the storage roller 40, the diameter of the stored curtain material, the spring constant of spring 52, the size of the gears 50 and 66, the size of drive roller 70 and its cogs/pins 72, and the weight of the curtain material 22 will all influence the slight change in pre-tension.

As the shaft 44 and cylindrical tube member 40 are rotated to either bring the curtain material down to cover the opening 25 or to move it in the reverse direction in storing the curtain material on the storage roller 40, this predetermined tension maintains the curtain material taut between the cogs/pins 72 on the drive roller 70 and the storage roller 40. As a result, the flexible curtain material is maintained in a neat and orderly wrapped up condition without folds or wrinkles. The tension that is provided between the storage roller 40 and shaft 44 remains essentially constant in unwinding and winding up the curtain material. As discussed earlier, the diameter of the curtain material 22 on the storage roller slightly influences the tension between the storage roller 40 and the drive roller 70.

Although this invention has been specifically described for use in connection with a flexible material, those skilled in the art will readily recognize that the principles can be applied to other covering such as garage doors or slatted door coverings.

Those skilled in the art will recognize that the invention has been set forth by way of example only and that changes may be made to the invention without departing from the spirit and the scope of the appended claims.

What is claimed is:

1. A storage and driving mechanism in combination with a covering comprising a rotatable storage roller for storing and dispensing said covering, a rotatable drive shaft, a spring operating between said rotatable storage roller and said rotatable drive shaft, a drive mechanism, said drive mechanism driving said rotatable drive shaft, said rotatable drive shaft being rotated in the same direction as said rotatable storage roller as said covering is dispensed or stored, a drive roller which drives said rotatable drive shaft, said rotatable storage roller and said covering, said drive roller rotating in a direction opposite of said rotatable drive shaft and said rotatable storage roller.

2. A storage and driving mechanism as claimed in claim 1 wherein said drive roller includes a drive gear and wherein said rotatable drive shaft includes a shaft gear, and further comprising intermediate gears interconnected to said shaft gear and said drive gear.

3. A storage and driving mechanism in combination with a flexible curtain comprising a rotatable storage roller for storing and dispensing said flexible curtain, a rotatable drive shaft, a drive roller, a spring operating between said rotatable storage roller and said rotatable drive shaft, an inverted belt operating between said rotatable drive shaft and said drive roller, said rotatable drive shaft and said rotatable storage roller rotating in a direction opposite to the direction of rotation of said drive roller, and, said rotatable drive shaft being rotated in the same direction as said rotatable storage roller as said curtain is dispensed or stored.

4. A storage and driving mechanism in combination with a curtain comprising a storage roller and a drive shaft, said drive shaft having first and second end portions, a spring having a first end affixed to said first end of said drive shaft and having a second end affixed to said roller, said drive shaft affixed to a first gear, a drive roller affixed to a drive gear and driving said curtain, and, said drive gear driving said first gear and imparting torsion to said drive shaft and said spring.

5. A storage and driving mechanism as claimed in claim 4 where said storage roller is rotatable relative to said drive shaft and wherein said curtain is a flexible curtain interconnected between said storage roller and said drive roller, said drive roller includes a cog and said curtain includes apertures for interengaging said cogs, said storage roller being rotated relative to said drive shaft pre-tensioning said storage roller relative to said shaft and creating tension in said curtain between said storage roller and said drive roller.

6. A storage and driving mechanism in combination with a covering comprising a rotatable storage roller for storing said covering, a rotatable shaft, a spring interconnected between said rotatable shaft and said rotatable storage roller, a rotatable drive roller which includes driving cogs thereon, said covering having apertures therein and residing wound on said rotatable storage roller until being extended therefrom by unwinding said covering and interengaging said apertures of said covering with said cogs of said drive roller pre-tensioning said drive roller with respect to said rotatable shaft, said rotatable shaft and said rotatable storage roller being driven by said drive roller, and, said rotatable shaft and said rotatable storage rolls being driven in the opposite rotational direction of said drive roller maintaining said pre-tension between said drive roller and said rotatable shaft.

7. A driving and storing mechanism in combination with flexible curtain material that covers an opening in a structure comprising a cylindrical tube member having an outer cylindrical surface for the reception of a length of curtain material in a rolled up configuration, said curtain member includes openings in the sides thereof, a first shaft having first and second end portions with said first end portion extending coaxially into said tube member, said second end portion of said first shaft extending exteriorly of said tube member, a first gear connected to said second end portion of said first shaft for rotation in unison therewith, a torsion spring surrounding said first end portion of said first shaft and connected at one end portion to said first shaft and at another end portion to said tube member, a first idler gear mounted for rotation about a first idler shaft and in meshing engagement with said first gear, a second idler gear mounted for rotation about a second idler shaft and in meshing engagement with said first idler gear, a curtain drive gear mounted for rotation about a second shaft and in meshing engagement with said second idler gear; a curtain engagement member mounted on said second shaft for rotation therewith and with said curtain drive gear, said curtain engagement member having pins for engagement with said openings in said sides of said curtain material, a drive motor having a drive shaft which in turn is connected to a drive motor gear which meshes with said curtain drive gear, rotation of said drive motor in one direction causes said curtain material to be unrolled from said tube member to cover an opening and in the opposite direction causes said curtain material to be rolled up onto said tube member to uncover said opening.

8. A driving and storing mechanism in combination with flexible curtain material that covers an opening in a structure comprising a cylindrical member having a cylindrical surface for the reception of a length of curtain material and adapted for rotational movement, a drive shaft, a spring member having first and second end portions, said first end portion of said spring member connected to said drive shaft and said second end portion of said spring member connected to said cylindrical member, said spring member permitting relative rotational movement between said cylindrical member and said drive shaft, a drive member adapted for rotational movement and having a plurality of curtain engaging members thereon, said length of said curtain material having drive surfaces engageable with said curtain engaging members to move said curtain material between open and closed position relative to said opening upon rotation of said drive member, and, said drive member rotating in the opposite direction of rotation of said drive shaft and said cylindrical member.

9. A method of operating a mechanism for storing and driving a covering, the mechanism having a rotatable storage roller, a rotatable drive roller, a first shaft, a spring interconnected between said storage roller and said shaft, said drive roller driving said shaft, comprising the steps of unwinding said covering from said storage roller, pre-tensioning said storage roller with respect to said shaft, placing said covering into engagement with said driver roller, rotating said drive roller dispensing or rewinding said covering, and rotating said shaft in a direction opposite to said drive roller.

10. A method of operating a mechanism for storing and driving a flexible curtain, the mechanism having a rotatable storage roller, a first rotatable shaft, a spring interconnected between said storage roller and said first rotatable shaft, a rotatable drive roller, said drive roller driving said shaft and said storage roller, comprising the steps of:

unwinding said flexible curtain from said storage roller in a first rotational direction such that said flexible curtain is dispensed from the rearward side of said storage roller;

pre-tensioning said storage roller with respect to said shaft;

placing said flexible curtain into engagement with said drive roller;

driving said rotatable shaft with said drive roller;

rotating said drive roller in a direction opposite to said first directional rotation of said storage roller dispensing said flexible curtain from said rotatable storage roller; and, rotating said drive roller in said first rotational direction and rotating said storage roller in the opposite rotational direction rewinding said flexible curtain on said rotatable storage roller.

11. A method of storing and driving a flexible curtain as claimed in claim 10 further comprising the steps of:

interengaging apertures in said curtain with cogs on said drive roller.

* * * * *

UNITED STATES PATENT AND TRADEMARK OFFICE

CERTIFICATE OF CORRECTION

PATENT NO. : 6,257,305 B1
DATED : July 10, 2001
INVENTOR(S) : Willis J. Mullet, et al.

It is certified that error appears in the above-identified patent and that said Letters Patent is hereby corrected as shown below:

Column 5,
Line 3, delete "for mounting"
Line 62, delete "78", insert -- 67 --

Signed and Sealed this

Fourth Day of December, 2001

*Attest:*

Nicholas P. Godici

*Attesting Officer*

NICHOLAS P. GODICI
*Acting Director of the United States Patent and Trademark Office*